United States Patent [19]

Knutson

[11] Patent Number: 4,659,909

[45] Date of Patent: Apr. 21, 1987

[54] KITCHEN RANGE SAFETY SHUTOFF

[76] Inventor: Arthur E. Knutson, 22325 4th Pl. West, Bothell, Wash. 98021

[21] Appl. No.: 821,626

[22] Filed: Jan. 23, 1986

[51] Int. Cl.[4] ..... H05B 1/02

[52] U.S. Cl. ..... 219/452; 307/116; 361/1; 340/628; 219/509; 219/489

[58] Field of Search ..... 219/452, 451, 448, 449, 219/509, 453, 445, 446, 396, 397, 447, 459, 518, 494, 489, 492; 236/15 E; 340/628, 629, 630; 361/1; 307/116

[56] References Cited

U.S. PATENT DOCUMENTS

| | | | |
|---|---|---|---|
| 3,328,789 | 6/1967 | Pacheco | 340/628 |
| 3,772,499 | 11/1973 | Fritzsche | 219/494 |
| 3,912,904 | 10/1975 | Phifer | 219/413 |
| 4,070,670 | 1/1978 | Chen | 219/509 |
| 4,177,461 | 12/1979 | Brown | 340/628 |
| 4,223,692 | 9/1980 | Perry | 340/628 |
| 4,356,385 | 10/1982 | Stein | 219/494 |
| 4,431,907 | 2/1984 | Barnett | 219/449 |
| 4,481,404 | 11/1984 | Thomas | 219/396 |

*Primary Examiner*—E. A. Goldberg
*Assistant Examiner*—Teresa J. Walberg
*Attorney, Agent, or Firm*—Ward Brown; Robert W. Beach

[57] ABSTRACT

A smoke detector is mounted externally of but adjacent to an electric kitchen range and supplies an electrical signal when smoke is detected. Such signal actuates a relay to interrupt the supply of power to the range. The relay can be interposed between the range plug and its wall receptacle so that no modification to the internal range circuitry is required, and can require a manual resetting operation before the supply of power to the range is resumed.

4 Claims, 2 Drawing Figures

KITCHEN RANGE SAFETY SHUTOFF

BACKGROUND OF THE INVENTION

1. Field of the Invention

The present invention relates to a device for automatically cutting off the power to an electric kitchen range when a fire occurs or is imminent.

2. Prior Art

Phifer U.S. Pat. No. 3,912,904, issued Oct. 14, 1975, and Barnett U.S. Pat. No. 4,431,907, issued Feb. 14, 1984, disclose electric kitchen ranges with built-in temperature-responsive elements to protect the internal circuitry from overheating, but are not concerned with the problem of fires caused by inadvertence during operation of the range. Such fires can be worsened by continued operation of the range heating elements such as if the range has been left unattended or the fire itself prevents turning off the range elements by use of the manual controls.

SUMMARY OF THE INVENTION

The principal object of the present invention is to provide a device which will lessen the possibility of a fire caused by operation of an electric kitchen range.

It also is an object to provide such a device which will lessen the resulting damage should such a fire occur.

Another object is to provide such a device in a form usable with any known electric kitchen range with no modification to the internal range circuitry being required.

An additional object is to provide such a device of simple inexpensive construction, utilizing known components and simple and quick to install.

The foregoing objects can be accomplished by a safety shutoff incorporated in the power supply circuit for an electric kitchen range and automatically actuated by smoke detected in the area of the range to cut off the supply of power to the range. In the preferred embodiment, a smoke detector mounted externally of the range actuates a relay which is interposed between the range plug and its wall receptacle and, when the smoke has cleared, the safety shutoff system must be reset manually before the range can be operated again.

DETAILED DESCRIPTION

Figure 1:
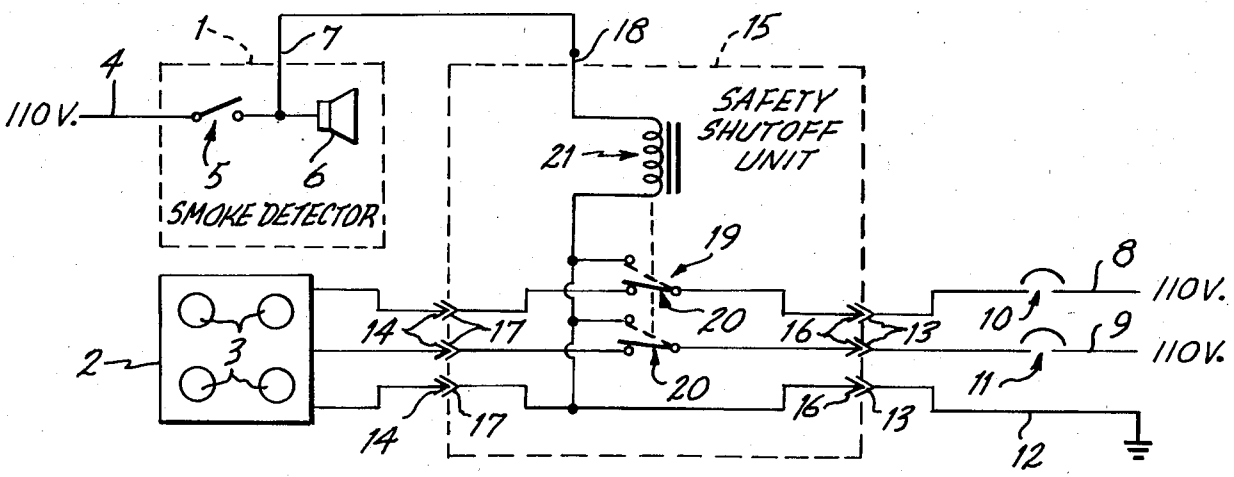
FIGS. 1 and 2 are corresponding schematic circuit diagrams of alternative kitchen range safety shutoffs in accordance with the present invention.

As shown in the drawings, the present invention utilizes a conventional smoke detector 1 mounted externally but in the general area of a conventional electric range 2 which can have the usual burners 3 and one or more ovens (not shown). Preferably the smoke detector is powered by a standard house line 4 of 120 volt, 60 hertz, alternating current electricity. The smoke detector has an internal smoke-actuated switch 5 which, when closed as a result of smoke being detected, actuates an alarm such as a horn 6. In addition, preferably the smoke detector is of the type having an auxiliary output line 7 conveying electricity when switch 5 is closed. Such an auxiliary output line is provided in some AC powered smoke detectors for the purpose of interconnecting two or more detectors so that the alarm of each detector is actuated when smoke is detected by any one of them. An appropriate smoke detector for use in the present invention is the Model SA1839 detector sold under the trademark "First Alert" by Pittway Corporation of Aurora, Ill.

Power to the range 2 for operating its electric heating elements is by the conventional house wiring, namely, power supply lines 8 and 9 having current-responsive, normally resettable circuit breakers 10 and 11, respectively. Supply lines 8 and 9 and a groundline 12 terminate at the conventional wall receptacle 13 for the range plug 14. In accordance with the present invention, however, a safety shutoff unit 15 (FIG. 1) or 15' (FIG. 2) actuated by the smoke detector 1 is interposed between the power source and the range. Such safety shutoff unit can be incorporated in the home wiring but preferably has a plug 16 mating with the wall receptacle 13 and a receptacle 17 mating with the range plug 14 for convenient installation of the unit at any desired time with no modification required for the home or range wiring. The safety shutoff unit 15 also has an input control line 18 connectable to the auxiliary output line 7 of the smoke detector 1.

Preferably the safety shutoff unit 15 or 15' has an internal relay 19 with two normally closed, ganged switches 20 for conveying power from supply lines 8 and 9 through the safety shutoff unit to the range. When smoke is detected by detector 1, however, switches 20 are automatically opened to the broken line positions shown in the drawings by interconnection of the smoke detector auxiliary output line 7 to the safety shutoff unit input control line 18 for powering the electromagnet 21 which results in opening the switches.

In the embodiment shown in FIG. 1, opening the relay switches 20 to the broken line positions connects both of the power supply lines 8 and 9 to the ground 12 which trips the circuit breakers 10 and 11. Consequently, as soon as smoke is detected by the detector 1, power to the range is cut off and cannot be resumed without manually resetting the circuit breakers, even though the switches 20 of the shutoff unit 15 will close automatically when the smoke has cleared. This prevents automatic resumption of the supply of power to the range which could restart the fire, such as if the range has been left unattended.

Figure 2:
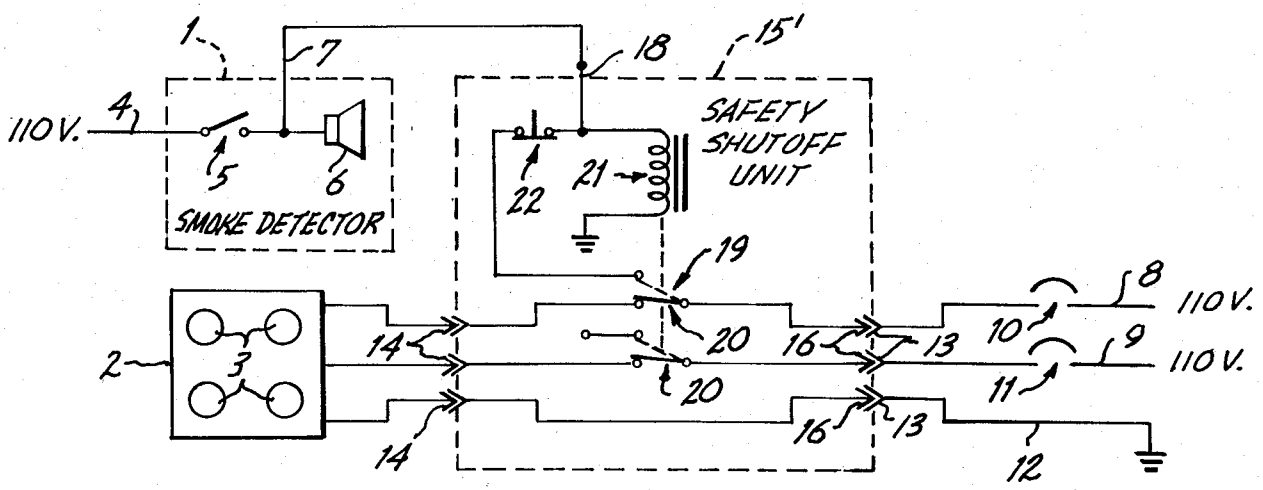

In the embodiment shown in FIG. 2, opening the relay switches 20 to the broken line positions connects one of the power supply lines (line 8 as shown in FIG. 2) to the electromagnet 21 through a manually actuated reset switch 22. Switch 22 can be mounted externally of the range at any convenient location. After the smoke has cleared, the relay switches remain in their open positions until the reset switch is opened manually, momentarily, whereupon the relay switches close to restore power to the range.

Since no modification is made to the internal wiring of the range, the safety shutoff in accordance with the present invention can be used with any known electric range.

I claim:

1. A safety shutoff for a range installation including an electric range having an electric heating element and means for normally conveying power to the range, such power-conveying means including manually resettable circuit breaker means for cutting off the supply of power through the power-conveying means to the range when current exceeding a predetermined current is detected, said shutoff comprising a smoke detector mounted externally of the range and including means for supplying an electrical signal when smoke is detected, and power cutoff means connected to and actuated by said signal-supplying means for automatically interrupting the supply of power through the power-conveying means to the range when smoke is detected, said power cutoff means including means for automatically grounding the power-conveying means upon receipt of said signal so as to actuate the circuit breaker means and require manual resetting of the circuit breaker means before the supply of power to the range can be resumed.

2. The safety shutoff defined in claim 1, in which the range has a power plug and the power-conveying means includes a wall receptacle adapted to receive said plug, the power cutoff means including a relay interposed between said plug and said receptacle.

3. A safety shutoff for a range installation including an electric range having an electric heating element and means for normally conveying power to said element, said shutoff comprising a smoke detector mounted externally of the range and including means for supplying an electrical signal when smoke is detected, relay means including an electromagnet connected to and actuated by said signal-supplying means and a relay switch actuated by said electromagnet, said relay switch being normally closed to convey power therethrough to the range but automatically opened by operation of said electromagnet when smoke is detected, said switch in its open position conveying power to said electromagnet to maintain said electromagnet actuated even after the smoke has cleared, and a reset switch actuatable only manually to cutoff the supply of power to said electromagnet for resuming the supply of power to the range after the smoke has cleared.

4. The safety shutoff defined in claim 3, in which the range has a power plug and the power-conveying means includes a wall receptacle adapted to receive said plug, the relay being interposed between said plug and said receptacle.

* * * * *